United States Patent [19]

Sarkisian

[11] 4,265,040

[45] May 5, 1981

[54] TWO-SIDED DISPLAY DEVICES

[76] Inventor: Robert Sarkisian, 4276 Stoneleigh Rd., Bloomfield Hills, Mich. 48013

[21] Appl. No.: 10,309

[22] Filed: Feb. 8, 1979

[51] Int. Cl.[3] ..... G09F 7/02

[52] U.S. Cl. ..... 40/618; 40/606

[58] Field of Search ..... 40/16, 16.4, 16.6, 17, 40/618, 606, 13, 10

[56] References Cited

U.S. PATENT DOCUMENTS

| | | | |
|---|---|---|---|
| 1,972,959 | 9/1934 | Taylor | 40/16.2 |
| 2,172,282 | 9/1939 | Hopp | 40/16.2 |
| 2,592,386 | 4/1952 | Breakey | 40/17 |
| 2,815,594 | 12/1957 | Heselov | 40/16.2 |
| 2,847,776 | 8/1958 | Robertson | 40/16.6 |
| 3,171,179 | 3/1965 | Lee | 40/16.4 |
| 3,310,901 | 3/1967 | Sarkisian | 40/13 |
| 3,458,945 | 8/1969 | Edwards | 40/618 |
| 3,535,807 | 10/1970 | Baldwin | 40/618 |

*Primary Examiner*—Gene Mancene
*Assistant Examiner*—Wenceslao J. Contreras
*Attorney, Agent, or Firm*—Harness, Dickey & Pierce

[57] ABSTRACT

A display device having track members on two sides of a single backing member for securely gripping and holding differently sized posters, signs and advertising materials is disclosed. The track members comprise elongated extrusions having one or more flange members thereon which mate with corresponding projections or rib means on the backing member of the display device. The advertising materials are inserted on the display device so that at least one edge thereof is positioned between a flange member and one or more projections. The panels are held securely in place by tension. A plurality of frame-like members are preferably positioned on the exterior edges of the backing panel.

11 Claims, 6 Drawing Figures

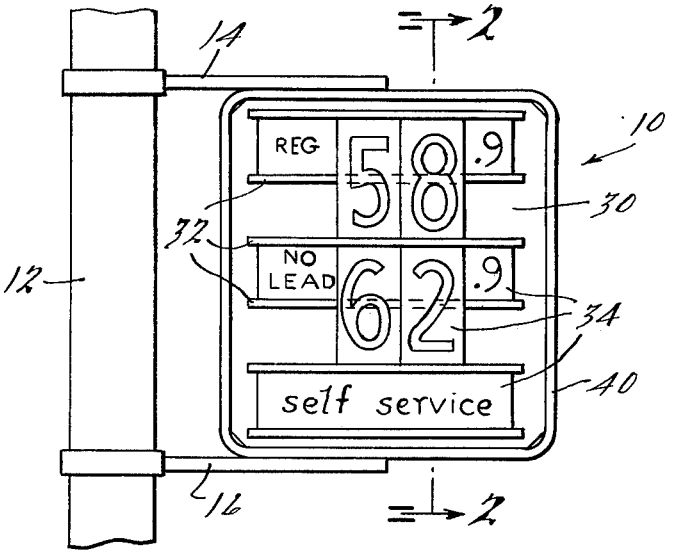
Fig. 1.
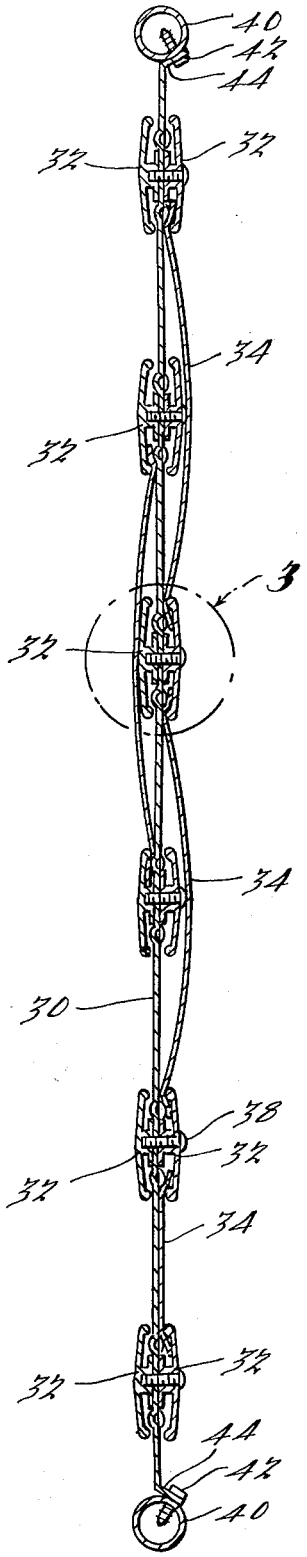
Fig. 2.
Fig. 3.
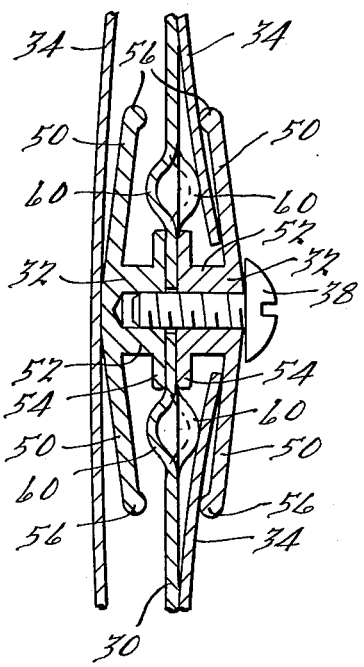

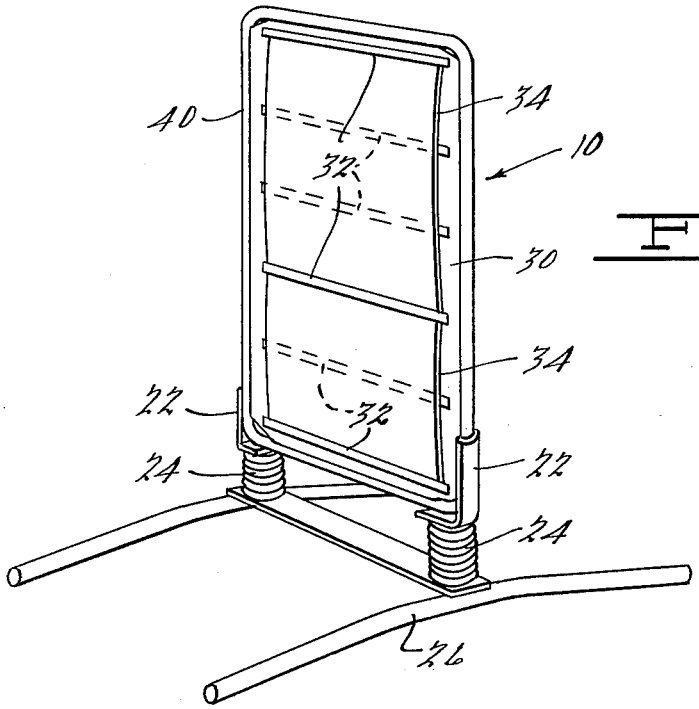
FIG. 6.
FIG. 4.
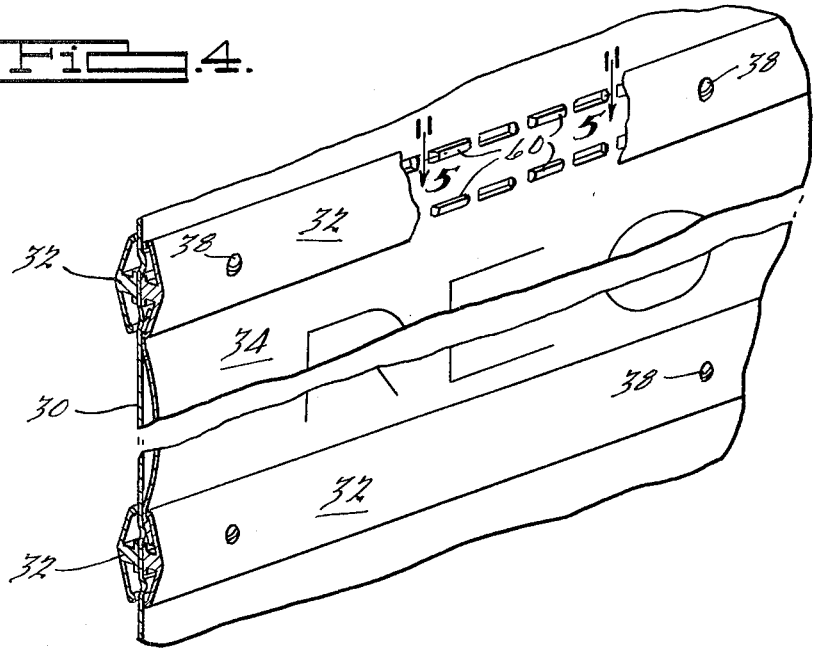
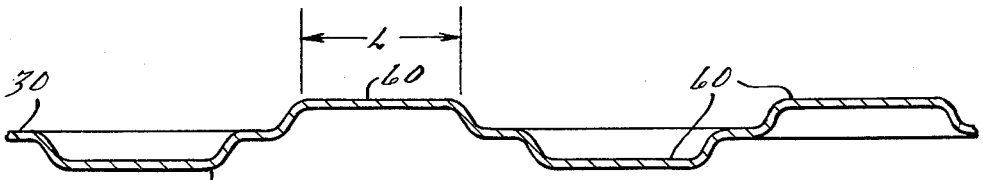
FIG. 5.

TWO-SIDED DISPLAY DEVICES

BACKGROUND-SUMMARY OF THE INVENTION

The present invention relates to an improved two-sided sign or display holder and more particularly to a display device having one or more track members thereon for securely gripping, holding and displaying advertising materials, and which has only one backing member, yet has the same features on both sides and can present for viewing the same messages on both sides.

There are a number of known types of poster, sign, advertising and display devices which are used on a number of different vehicles and structures and in a number of different situations. For example, display devices are typically seen on buildings, such as service stations, train stations, airports and subways, on various styles and types of sign posts and portable stands, and on vehicles, such as trains, busses and taxi cabs. Signs and display devices also are utilized along our roads and highways to supply notices and other information to the public. Many of these conventional devices present a message only on one side (thus are "one-sided") while others present messages for viewing by the public and passers-by in two directions (thus are "two-sided").

Many known signs and display devices are difficult and time consuming to assemble in the first instance. Also, it is frequently difficult with many holders to change the sign or advertising message without significant effort or disassembly of fastener type parts. Further, many display devices are not adapted to use posters, signs or panels of different sizes and shapes (particularly at the same time). Often the advertising and information materials have to be a certain size or shape in order to fit in the particular sign device and a small discrepancy of one dimension could make the advertising material useless for the display device or require substantial alteration of either the device or the sign.

Moreover, in known display devices where the panel or advertising materials are inserted in a bowed condition, the panels frequently are subject to having wind forces get behind them and slide or dislodge them causing numerous problems to both the advertiser and the public. Also, if a plurality of bowed panels are utilized in one device, often the panels are bowed to different degrees creating an unpleasing appearance and a difficult message to read.

When two-sided display devices are normally utilized, two separate one-sided devices are simply placed back-to-back and joined together in some manner. This creates an unnecessary duplication of materials and labor, both in the manufacture and assembly of the devices, as well as their installation. Also, such two-sided devices are normally heavy and bulky (primarily due to the duplication of features and materials), thus requiring specially designed or strengthened supporting and hanging mechanisms, as well as additional space for installation.

It is an object of the present invention to provide improved sign and display devices which overcome all of the aforementioned disadvantages of known sign and display devices. One display device which overcomes many of these disadvantages is described in the copending application of the same inventor, Ser. No. 660,702, filed on Feb. 23, 1976. The present invention is an improvement over the unique and beneficial invention disclosed and claimed in that application.

The present invention can be used for all types and sizes of posters, signs, advertising materials and panels. Also, it can be used either indoors or outdoors, along roads, and on vehicles, buildings, walls, posts, portable display stands and the like of all types. Specifically, portable display devices on which the present invention can be used are shown, for example, in U.S. Pat. No. 3,646,696, issued on Mar. 7, 1972, and in U.S. Pat. No. 3,662,482, issued on May 16, 1972. In these two patents, the display devices or holders are connected by a pair of coil springs to an unanchored, portable base structure and the springs permit the display devices to deflect in either direction, such as when a strong wind force is applied thereto, without danger of sliding or tipping over. Also, in accordance with these two patents, the base structure can be virtually weightless.

Other objects of the present invention are to provide a relatively uncomplex and simple two-sided display device relative to assembly and utilization, a display device which can be quickly assembled, an aesthetic, durable and attractive advertising medium which can be viewed in two directions, and an inexpensive holder or device with relatively few parts.

Another object of the present invention is to provide a multi-purpose display device adapted to handle a plurality of differently sized and shaped advertising materials and panels, the multi-sized panels being able to be used separately or many at the same time. A further object is to provide a display device adapted to securely hold and display a number of differently sized advertising or message panels that can be held alternately only on one edge or on two or more edges.

A still further object of the present invention is to provide a two-sided display device which has all of the benefits and advantages of the display devices disclosed and claimed in the above-mentioned copending application Ser. No. 660,702.

A preferred embodiment of the present invention generally comprises an improved sign or display device having a single backing member with one or more elongated track members positioned on each side for securely holding, gripping and displaying a plurality of differently sized and shaped advertising materials. The track members have at least one flange member on them which mates with a series of elongated projections or rib means formed in each side of the backing member. The track members are attached to the display holder and can be positioned according to the advertiser's needs and desires. The adversiting materials or panels are quickly and easily positioned on the display device with at least one edge inserted between a track flange member and corresponding projection or group of projections. In this manner, the panels are held by tension on both sides of the device and the messages thereon are attractively and suitably displayed in two directions. The arrangement of the pressure points on each side of the backing member, that is the flange on the track member and the rib means on the backing surface, cause the panels to be tensioned and curved inwardly toward the backing surface. The track members are relatively flat and larger advertising materials and panels can be positioned on non-adjacent track members.

Preferably, the display device has a plurality of track members positioned inwardly of the edges on each side of the backing member to hold the panels and a second plurality of track or display-holding members along the outer edges of the backing member forming frame-like configurations on each side. Such frame-like members can be, for example, similar to those disclosed in U.S. Pat. No. 3,310,901.

The foregoing as well as other objects, features and aspects of the present invention will become apparent from the following description and claims when considered in connection with the accompanying drawings.

BRIEF DESCRIPTION OF THE DRAWINGS

The present invention is described in more detail in the accompanying drawings in which:

FIG. 1 is a display device in accordance with the present invention and illustrates one possible use thereof;

FIG. 2 is a cross-sectional view taken along line 2—2 of FIG. 1;

FIG. 3 is an enlarged view of a portion of the structure shown in FIG. 2, as indicated by the circular area marked by the numeral 3 in FIG. 2;

FIG. 4 is a perspective view of a portion of a display device in accordance with the present invention further illustrating some of its features;

FIG. 5 is a cross-sectional view taken along line 5—5 of FIG. 4; and FIG. 6 illustrates the use of the present invention on a spring mounted sign holder.

DESCRIPTION OF THE PREFERRED EMBODIMENTS

FIG. 1 illustrates a display device in accordance with the present invention and illustrates one possible use thereof. In the situation depicted, the invention is adapted for use at a gas or service station. A two-sided display device 10 is fastened to a post or other member 12. The device 10 is attached to the post 12 by two support brackets 14 and 16.

Another possible use of the invention is shown in FIG. 6. In this illustration, two-sided display device 10 is attached by means of mounting brackets 22 to a pair of coil-springs 24 which in turn are attached to a base 26. The use of this particular type of spring mounted display holder is described in more detail in U.S. Pat. Nos. 3,646,696 and 3,662,482, the disclosures of which are hereby incorporated by reference. Although the inventive two-sided display device is shown in FIGS. 1 and 6 in two particular applications, it is understood that the invention can be utilized with any known method or mechanism for holding, displaying or viewing signs.

Each display device 10 consists of a backing panel or member 30 and a number of track members or track units 32 which are positioned on and attached to the backing member 30 on both sides thereof. Since both sides of the display device 10 are substantially identical, only one side is shown in FIGS. 1 and 6. FIGS. 2–5, which are described below, particularly point out the two-sided features of the invention. The display devices 10 are adapted to securely hold and display one or more panels, posters, signs, advertising materials, and the like 34 on each face thereof for display.

Since the backing member 30 is only a single sheet or piece of material, it is preferable to include a frame of some type around the perimeter thereof, such as shown by the numeral 40 in FIGS. 1, 2 and 6. The frame 40 "fnishes" off the display device 10 and makes it a more attractive and asethic structure for use and viewing. The frame 40 also adds considerable strength and stability to the device 10 as the backing member 30 is peferably made of a single sheet of material. As shown in the drawings, the frame 10 is made of a bent piece of tubing and is attached by screws 42 to the edges 44 of the backing member 30. The edges 44 are bent at an appropriate angle to provide a mounting surface for the tubing.

If desired, other means can be used to provide a frame for the display device 10. For example, individual specially formed members (not shown) can be slid or snapped over the edges and mitred at the corner to provide an inexpensive, asethic frame. Also, the frame members shown in U.S. Pat. No. 3,310,901, the disclosure of which is hereby incorporated by reference, can be positioned along the edges on both sides of the backing member 30 to provide a versatile display device. In accordance with that patent, each of the edge members comprises two pivotably hinged portions which are biased to a closed position by a leaf-spring. One of the portions is secured to the backing member and the other portion is adapted to be pivoted to open and closed positions allowing insertion and removal of the display materials.

The track units 32 are shown in more detail in FIGS. 2–4. The units 32 preferably comprise a generally T-shaped or I-shaped extrusion having one or more flange members 50, a central core or stem 52, and a base portion 54. The track units 32 can have either one or two flange members 50 on them. Small nubs or rounded portions are situated at the outer ends 36 of the flange members 50 to assist in insertion of the panels 34 in the display device, as well as to hold them in place. Preferably, the flange members 50 slant downwardly from the stem 52 toward the ends 56 (as shown in FIGS. 2–4).

The track units 32 are made of a rigid metal materials such as aluminum, but they can also be made of plastic or another approprate material. Since the display holders 10 are capable of use both indoors and outdoors, the track units 32 should be made of material which will not rust, discolor, or deteriorate. They also can be made in any conventional manner, but preferably are extruded in elongated units in the shape shown in the drawings and cut to the desired length. Also, the outer face (or top) of each of the track units 32 preferably is painted in a matching or contrasting color to the desired advertising panels; in this manner, they will be less noticeable and will not detract from the message on the display device.

The backing panel 30 consists of a relatively rigid metal material such as aluminum, but it is understood that it can be any other material which meets the requirements of the present invention. Similar to the track units 32, the backing panel 30 should be made of a material which will not rust, discolor or deteriorate during use and exposure to the elements. Hence, it preferably should be made of a material having durability, substantial long life, an ability to maintain its integrity and quality throughout its life, and a pleasing appearance. The material also should be formable so that the requisite projections or rib means 60 (as described below) can be formed in it.

The track units 32 and corresponding rows of projections or rib means 60 preferably are placed horizontally on the interior portion of the backing panel 30 and are adapted to attractively and securely hold and display an advertising message, such as the price of gasoline at a service station, by means of sign panels or fonts 34 with appropriate numbers, letters, or the like thereon. Of course, the track units 32 and rib means 60 can be oriented in any direction on the backing member 30 in accordance with the desires and needs of the user of the device 10. The display devices 10 and sign panels 34 are normally designed as a package so that the track units 32 will be positioned at predetermined spaced locations on the backing member 30 and the sign panels 34 are provided of certain sizes to fit between the track members 32. The sign panels 34 are quickly and easily interchangable, as discussed in more detail below, to change the prices or advertise other products or services.

The sign panels, posters or advertising materials 34, which can be utilized in the display device 10, can be of any conventional design. The sign panels should be relatively stiff and durable so that they can be repeatedly inserted into and removed from the track units 32 without being bent, creased, or permanently deformed. Since the present invention is adaptable for use both indoors or outdoors, the sign panels 34, similar to the remaining parts of the display holder 10, should be made of a material which will not rust, discolor or deteriorate. Sheet metal panels made of aluminum with baked enamel messages thereon have shown to have the desired advantages and features.

The track units 32 can be attached to the backing panel 30 in any conventional manner, such as screws 38, as indicated in FIGS. 2 and 3. When pairs of track units 32 are positioned "back-to-back" on opposite sides of the backing member 30, as shown in FIGS. 2–4, it is possible to secure each pair of units to the backing members 30 with a single set of screws 38 or other fastening devices. A hole is provided in the backing member 30 and a screw 38 is inserted through a hole provided in one of the track units and secured into a corresponding hole in the base of another track unit.

A plurality of projections 60 (or rib means) are provided on the backing panel 30. Series of projections 60 are arranged in rows on each side of the backing member 30 and are adapted to mate with the track units 32 to securely hold the panels 34 in place in the manner shown in FIGS. 2–4. One row of projections 60 is provided on the backing member 30 for each flange 50 on the display device 10; thus, the backing panel 30 should be designed for the particular use to which the device 10 will be put. If the track unit 32 has two flanges 50, two corresponding rows of projections 60 are provided on the backing panel 30 in the appropriate positions.

Preferably, two track units 32 are positioned "back-to-back" on opposite sides of the backing member 30. In order for each of the units 32 to have a corresponding row of projections 60, the backing member 30 is formed with the projections 60 in each row being alternately protruding on opposite sides of the member 30. This is best shown in FIGS. 4 and 5. When a series of projections 60 is arranged in a row on the backing member, it essentially forms an elongated rib or rib means thereon. The length L of each projection 60 is preferably the order of $\frac{1}{4}''$–$\frac{1}{2}''$ so that a sufficient amount of projections 60 per unit length will exist on each side of the backing member 30 to securely hold the sign panels 34 in place.

The projections 60 can be molded in the backing member 30 when it is formed, or they can be stamped into the surface by use of an appropriate die mechanism after the member 30 is formed. Also, if the track units 32 are not positioned in the back-to-back mounting relationship as shown in the drawings, or the track units on one side of the display device are substantially greater in width than on the other side, then it is not necessary to form a series of individual projections 60 for mating with the track unit flanges 52. Instead, a single elongated rib can be provided along the entire length of the track unit 32 and used for the same purpose.

The ends 56 of the track units 32 and the rows of projections 60 on the backing member 30 provide two elongated pressure points acting on the ends of the sign panels 34. The two pressure points are arranged such that the panels 34 will be put in tension on the device 10. The tension causes the panels 34 to be curved inwardly toward the backing member 30 and to be firmly secured in place. The panels lie flat in the display holder which is particularly important for large sized panels. Panels held in position in this manner cannot be dislodged or displayed by wind forces and will not fall out even if the display device itself is accidently dropped or turned over.

The preferred positioning of the pressure points and the tension applied thereby to the sign panels 34 is shown in FIGS. 2 and 3. The panels 34 are bowed or curved inwardly such that they come in contact with the backing member 30 between adjacent track units 32. The tension and inward curvature applied to a sign panel 34 is sufficient to hold it firmly and securely in place even if the sign panel 34 is only held on one edge thereof. Thus, it is possible to use panels 34 which are too small to be inserted into and be held by two adjacent track units 32.

The display device 10 is also adapted to securely hold in place and display sign panels which are larger than the distance between adjacent track units 32, as well as smaller. This permits much flexibility and design choice in creating different advertising messages and highlighting and accenting various features of the message. As shown in FIG. 2, several larger-sized panels are positioned on both sides of the backing member 30 between non-adjacent track units 32. Similar positioning is shown in FIGS. 1 and 6. Due to the tension produced by the flange and projection or rib means pressure points, the panels 34 are tensioned toward the backing member 30 and hence are forced against and rest on the tops of the intermediate track units 32. In this same manner, the display holder 10 will easily and firmly hold in place a sign panel which extends the entire height of the device 10 and is secured only in the uppermost and lowermost track units.

When smaller-sized panels are used, that is panels which are too narrow to fit between two adjacent track units 32, they are held securely in place by only one track unit. The tension produced on the panel by the one track unit causes it to lie flat on the display holder.

The dimensions of the sign panels 34 should be such that they extend easily between adjacent or non-adjacent track units. The height of the panels does not have to be within exact limits, however, as the design of the track units and position of the pressure points provides sufficient clearance space for non-uniformly dimensioned panels. This is shown, for example, in FIGS. 2 and 3 where clearance spaces are shown between the ends of the panels 34 and the outer surfaces of the stem portion 52. The sign panels 34 can be of any convenient transverse width, depending on the numeral or message which is printed thereon.

A number of track units 32 are preferably provided on each side of the backing panel 30 in order to hold and display a number of advertising panels on each side, as well as a number of differently sized panels. It is possible, of course, to only provide a single track unit 32 on each side of the display 10, or only a pair of track units on each side, and thus provide only one line or space for a display. This could happen, for example, where the display device 10 is small in size, or where only large sign panels are to be displayed in it.

It is to be understood that the foregoing description describes only preferred embodiments of the invention and that various changes and modifications may be made without departing from the spirit and scope of the invention as defined by the appended claims.

I claim:

1. A display holder for displaying sign panels, said sign panels being held securely in place without permanent deformation and adapted for repeated use and reuse in said display holder, said display holder comprising a substantially flat backing member comprising a single sheet of material with two sides, at least one track member positioned on and secured to each side of said backing member, each of said track members having a pair of flanges thereon forming elongated channels between each of said flanges and a side of said backing member, each of said channels having an inner end and an outer open end, said sign panels being receivable into selected of said channels through said open end thereof, first rib means on each of said flanges adjacent the open ends of said channels and extending inwardly into said channels, and second rib means on each side of said backing member adjacent each of said channels, each of said second rib means comprising a plurality of projections extending inwardly into said channels and positioned in each of said channels between said first rib means and the channel inner end, said first and second rib means extending inwardly into each of said channels such that said sign panels positioned in said channels and abutting against the respective rib means associated therewith are held tightly in tension in said channels without permanently deforming said sign panels, said first and second rib means automatically biasing the portion of the sign panels outwardly of each of said channels in a direction toward the plane of and into engagement with each side of said backing member.

2. The display holder as defined in claim 1 further comprising frame means positioned around the perimeter of said backing member forming a frame-like assembly thereon.

3. The display holder as defined in claims 1 or 2 wherein said backing member is rectangular.

4. The display holder as defined in claim 1 wherein said track member is comprised of extruded aluminum and has a substantially T-shaped cross section.

5. The display holder as defined in claim 1 wherein said track members on opposite sides of said backing member are axially aligned in back-to-back relationship and said second rib means on opposite sides of said backing member are also axially aligned, said projections forming each of said axially aligned second rib means alternately extending toward one of said sides.

6. A display holder for displaying sign panels, said sign panels being held securely in place without permanent deformation and adapted for repeated use and reuse in said display holder, said display holder comprising a substantially flat backing member comprising a single sheet of material with two sides, a plurality of track members positioned on and secured to each side of said backing member, each of said track members having a flange thereon forming an elongated channel between said flange and one side of said backing member, said channel having an inner end and an outer open end, said sign panels being received into said channel through said open end thereof, first rib means on said flange adjacent the open end of said channel and extending inwardly into said channel, and second rib means on each side of said backing member, said second rib means comprising a plurality of projections extending inwardly into said channel and positioned between said first rib means and said inner end of said channel, said first and second rib means extending inwardly into said channel such that said sign panels positioned in said channel and abutting against each of said rib means are held tightly in tension in said channel without permanently deforming said sign panels, said rib means automatically biasing the portion of the sign panels outwardly of said channel in a direction toward the plane of and into engagement with each respective side of said backing member.

7. The display holder as defined in claim 6 wherein said track members on opposite sides of said backing member are axially aligned in back-to-back relationship and said second rib means on opposite sides of said backing member are also axially aligned, said projections forming each of said axially aligned second rib means alternately extending toward one of said sides.

8. The display holder as set forth in claim 6 wherein each of said track members has two flanges thereon, each of said flanges forming elongated channels and having said first and second rib means therein.

9. The display holder set forth in claim 6 wherein said track members are substantially T-shaped in cross-section.

10. The display holder set forth in claim 6 wherein said backing member is rectangular.

11. The display holder set forth in claim 6 further comprising frame means positioned around the periphery of said backing member forming a frame-like assembly thereon.

* * * * *

UNITED STATES PATENT AND TRADEMARK OFFICE

CERTIFICATE OF CORRECTION

PATENT NO. : 4,265,040

DATED : May 5, 1981

INVENTOR(S) : Robert Sarkisian

It is certified that error appears in the above—identified patent and that said Letters Patent is hereby corrected as shown below:

Column 2, Line 51 -"adversiting" should be --advertising--
Column 2, Line 54 - after "and" insert --a--
Column 3, Line 39 - after "illustration" insert --a--
Column 3, Line 66 -"fnishes" should be --finishes--

Column 4, Line 1 & 2-"peferably" should be --preferably--

Column 4, Line 30 -"36" should be --56--

Signed and Sealed this

*Fifteenth* Day of *June 1982*

[SEAL]

*Attest:*

GERALD J. MOSSINGHOFF

*Attesting Officer* *Commissioner of Patents and Trademarks*